US011745191B2

(12) United States Patent
Borel

(10) Patent No.: US 11,745,191 B2
(45) Date of Patent: Sep. 5, 2023

(54) DISPENSER FOR A PRESSURIZED CONTAINER

(71) Applicant: LINDAL FRANCE SAS, Val de Briey (FR)

(72) Inventor: Bernard Borel, Moirans (FR)

(73) Assignee: LINDAL FRANCE SAS, Val de Briey (FR)

( * ) Notice: Subject to any disclaimer, the term of this patent is extended or adjusted under 35 U.S.C. 154(b) by 178 days.

(21) Appl. No.: 17/439,004

(22) PCT Filed: Mar. 27, 2020

(86) PCT No.: PCT/EP2020/058829
§ 371 (c)(1),
(2) Date: Sep. 14, 2021

(87) PCT Pub. No.: WO2020/207831
PCT Pub. Date: Oct. 15, 2020

(65) Prior Publication Data

US 2022/0143629 A1 May 12, 2022

(30) Foreign Application Priority Data

Apr. 10, 2019 (FR) ..... 1903844

(51) Int. Cl.
*B05B 1/02* (2006.01)
*B65D 83/28* (2006.01)
*B65D 83/14* (2006.01)

(52) U.S. Cl.
CPC ..... *B05B 1/02* (2013.01); *B65D 83/28* (2013.01); *B65D 83/753* (2013.01)

(58) Field of Classification Search
CPC ..... B05B 1/02; B05B 1/3405; B05B 1/3436; B65D 83/28; B65D 83/753
(Continued)

(56) References Cited

U.S. PATENT DOCUMENTS 2,767,023 A 10/1956 Venus, Jr.
4,071,196 A * 1/1978 Burke ..... B65D 83/20 239/492
(Continued)

FOREIGN PATENT DOCUMENTS

DE 1118708 B 11/1961
DE 1166225 B 3/1964
(Continued)

OTHER PUBLICATIONS

International Search Report and Written Opinion dated Jun. 2, 2020 in corresponding application No. PCT/EP2020/058829 w/ English partial translation and partial machine translation (total 24 pages).

*Primary Examiner* — Steven J Ganey
(74) *Attorney, Agent, or Firm* — Seckel IP, PLLC

(57) ABSTRACT

A dispenser for a pressurized container is provided with an outlet channel that opens into a nozzle housing intended to receive and retain a nozzle (40) provided with a retention ring (43). The nozzle housing has a tubular wall (34) that is open towards the outside at its end opposite to the outlet channel. The tubular wall (34) is provided, at a distance from its end open towards the outside, with a support surface (341) that extends over at least a portion of its periphery and behind which at least a portion of the retention ring (43) of a nozzle introduced into the nozzle housing can come into engagement.

20 Claims, 4 Drawing Sheets

Figure 1:
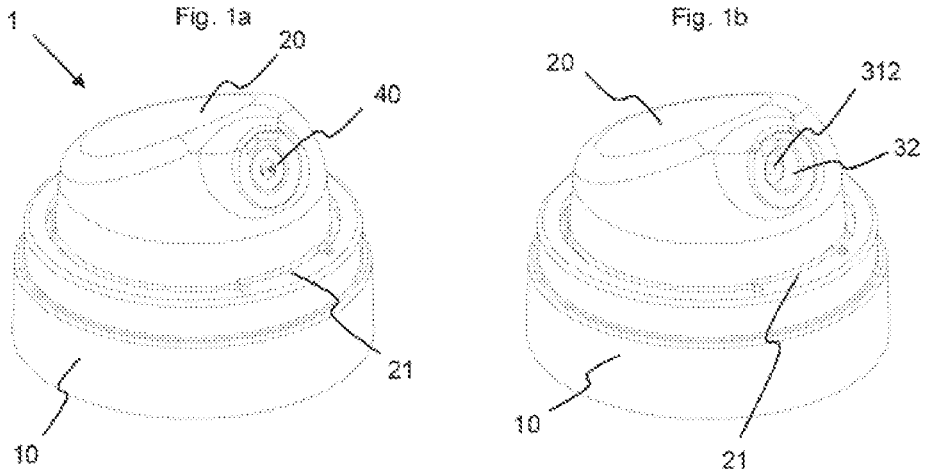

(58) Field of Classification Search
USPC ..... 239/337, 491, 492, 493, 552
See application file for complete search history.

(56) References Cited

U.S. PATENT DOCUMENTS

| | | | | |
|---|---|---|---|---|
| 4,583,692 | A * | 4/1986 | Sheffler | B05B 11/0005 239/493 |
| 5,992,765 | A * | 11/1999 | Smith | B05B 1/3436 239/337 |
| 10,940,493 | B2 * | 3/2021 | Levake | B05B 15/14 |
| 2013/0221122 | A1 | 8/2013 | Ganan-Calvo et al. | |
| 2015/0202638 | A1 | 7/2015 | Pouliaude | |
| 2018/0141744 | A1 | 5/2018 | Cassidy et al. | |

FOREIGN PATENT DOCUMENTS

| | | | |
|---|---|---|---|
| EP | 0561696 | A1 | 9/1993 |
| FR | 2994866 | A1 | 3/2014 |
| KR | 20120004669 | U | 6/2012 |

* cited by examiner

Fig. 3
Fig. 3a
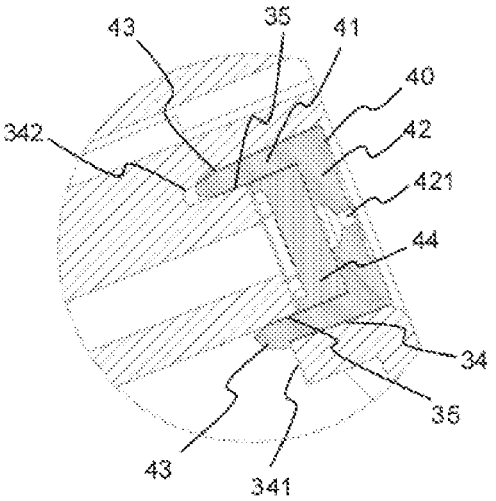
Fig. 3b
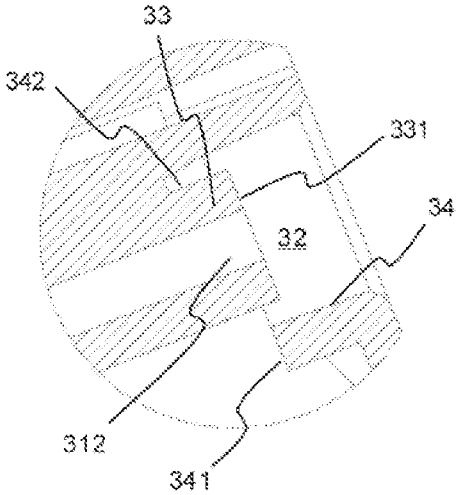
Fig. 4
Fig. 4a
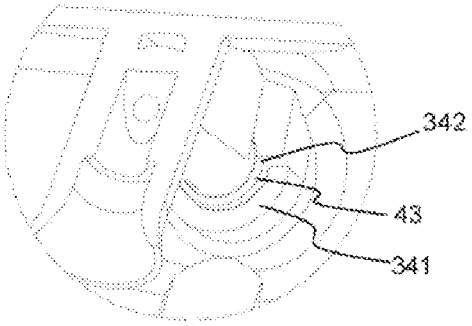
Fig. 4b
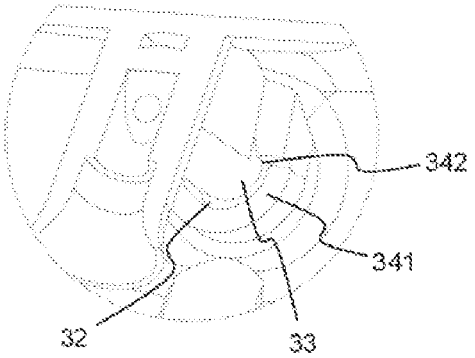
Fig. 5
Fig. 5a
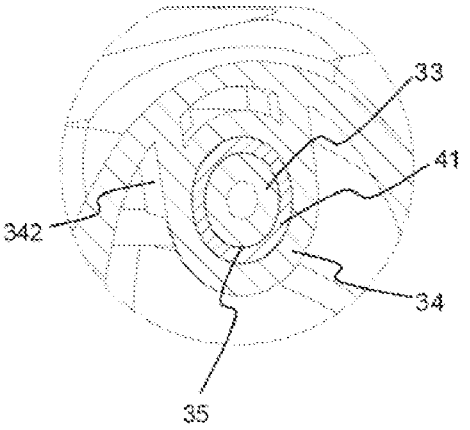
Fig. 5b
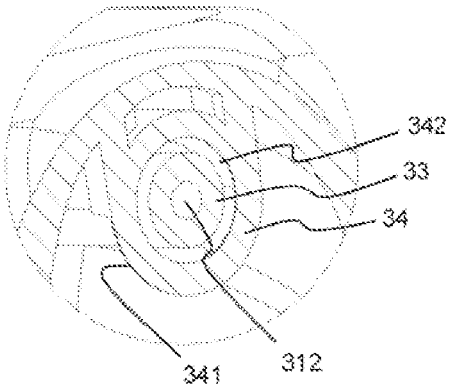

Fig. 6
Fig. 6a
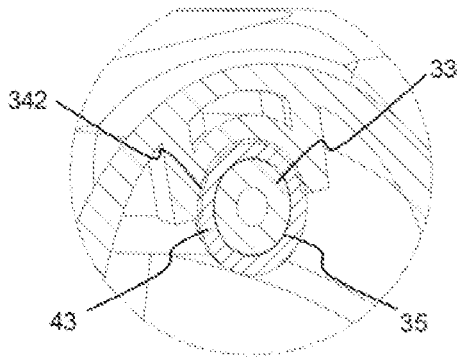
Fig. 6b
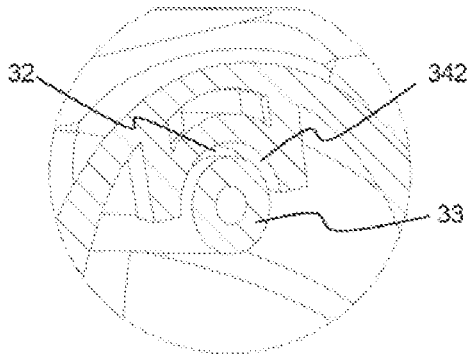
Fig. 7
Fig. 7a
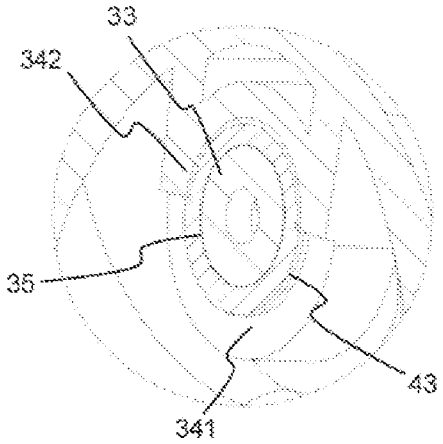
Fig. 7b
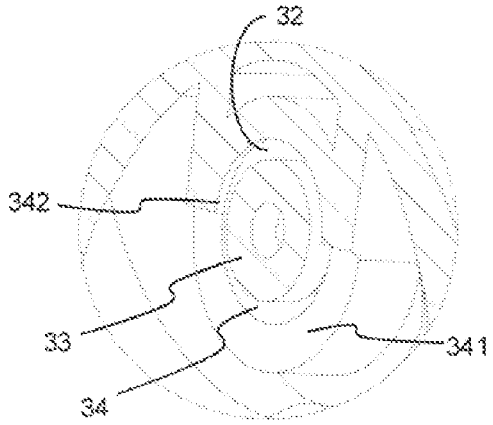
Fig. 8
Fig. 8a
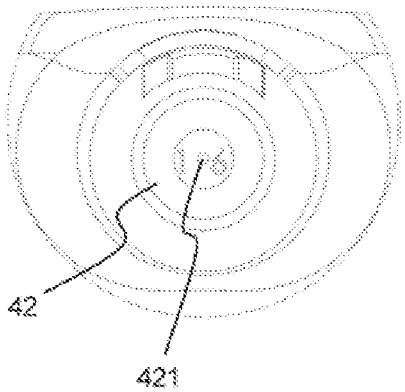
Fig. 8b
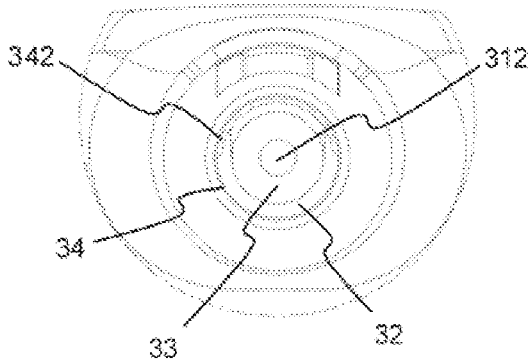

DISPENSER FOR A PRESSURIZED CONTAINER

The invention relates to a dispenser for a pressurized container, the dispenser being provided with an outlet channel that opens into a nozzle housing intended to receive and retain a nozzle provided with a retention ring, the nozzle housing comprising a tubular wall that extends around an axis and is open towards the outside at its end opposite to the outlet channel.

Such dispensers are known from the state of the art. The nozzle is generally constituted by a cylindrical wall closed on one side by a front wall provided with an outlet orifice and open on the other side. It carries a retention ring on the outer face of the cylindrical wall. During assembly, the nozzle is introduced by force, clamping the nozzle in the nozzle housing so that its retention ring slides against the wall of the housing. The retainer ring forms a "hard tooth" that comes to be caught in the softer material of the nozzle housing. This attachment system also ensures sealing between the nozzle and the nozzle housing.

This concept makes it possible to maintain the nozzle up to pressure and temperature values commonly used today. In particular, nozzles retained by deformation in this manner withstand pressures of up to 12 bars.

However, the current trend is to use compressed gases as propellant gas, so that the pressures used are much higher and can reach 20 bars or more.

The objective of the invention is therefore to modify the retention mode of the nozzle so that it withstands higher pressures, and in particular, so that it withstands at least 20 bars.

This objective is achieved in that the tubular wall of the nozzle housing is provided, at a distance from its end open towards the outside, with a support surface that extends over at least a portion of its periphery and behind which at least a portion of the retention ring of a nozzle introduced into the nozzle housing can come into engagement. In at least a portion of the housing, the invention provides a positive attachment due to the fact that the retention ring, playing the role of a hook, is positioned behind the support surface against which it is supported. The nozzle is blocked much more effectively than with the traditional retention by deformation, even if this snap-fastening is not done all around the nozzle housing. The advantage of the invention lies in particular in that it is possible to use common nozzles. It is not necessary to have nozzles specific to this type of dispenser.

The support surface is preferably defined by at least an angular section of a surface having rotational symmetry relative to the axis. In particular, the support surface can be substantially radial relative to the axis.

Due to the technical constraints for molding the outlet channel, it is not always possible for the support surface to extend over the entire periphery of the nozzle housing. This is notably the case when the outlet channel forms an integral part of the finger tab that makes it possible to actuate the valve. In this case, the support surface extends only over an angular section of the periphery of the tubular wall, said tubular wall being continued, opposite to its open end, in the angular section complementary to the support surface, by an extension into which the portion of the retention ring of a nozzle which is not engaged with the support surface can come to be caught by deformation of the extension. Such a partial snap-fastening is already sufficient to guarantee effective retention, even at pressures of at least 20 bars.

Since the sealing between the nozzle and the housing is not always ensured in the area of the snap-fastening of the retention ring behind the support surface, it can be necessary to provide sealing means between the housing nozzle and a nozzle introduced into said housing, these sealing means being distinct from the interaction between the retention ring of a nozzle and the tubular wall of the nozzle housing.

The outlet channel can be provided, at its end that opens into the nozzle housing, with a stud intended to penetrate into a corresponding recess of a nozzle. The transverse cross-section of the stud can in particular be dimensioned to be greater than that of the recess of a nozzle for which it is intended, so as to be able to create, when a nozzle is placed in the nozzle housing with the stud penetrating into the recess, a sealed annular surface at the interface between the stud and the nozzle. The contact zone constitutes an exemplary embodiment of the sealing means.

It is preferable that the stud protrudes into the nozzle housing so that its front face is axially closer to the open end of the tubular wall than the support surface.

Although other shapes can be envisioned, in particular elliptical shapes, it is preferable that the transverse cross-section of the tubular surface and/or the transverse cross-section of the stud are in the shape of a circle.

The invention also relates to a dispenser in which a nozzle provided with a retention ring is introduced into the nozzle housing, at least a portion of the retention ring being engaged behind the support surface. In particular, the portion of the retention ring of the nozzle which is not engaged with the support surface can be attached to the tubular surface by deformation of its extension.

Figure 2:
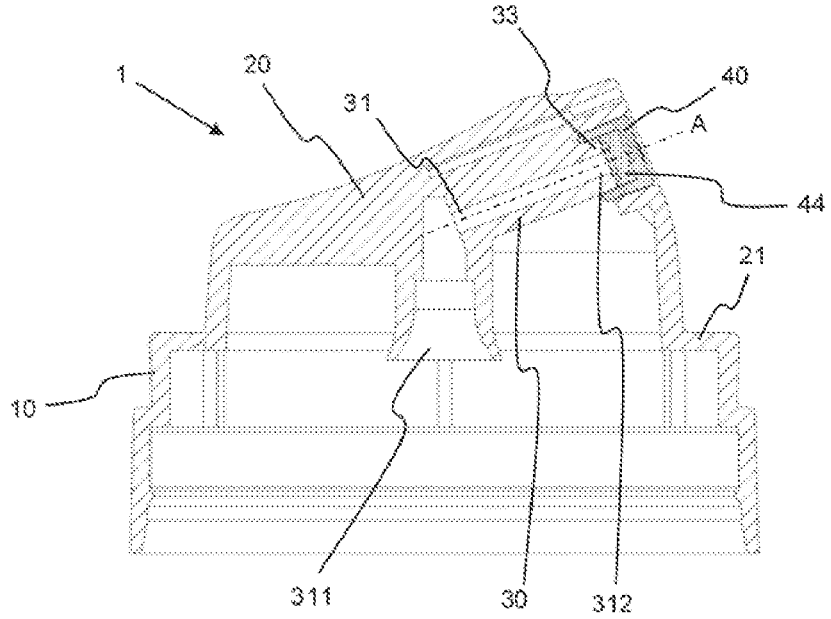
Figure 9:
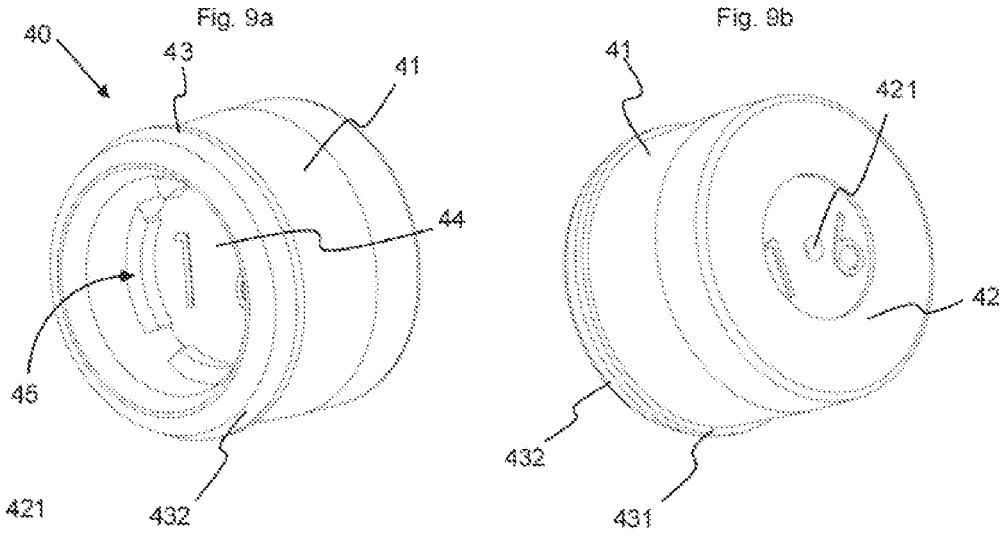
Figure 10:
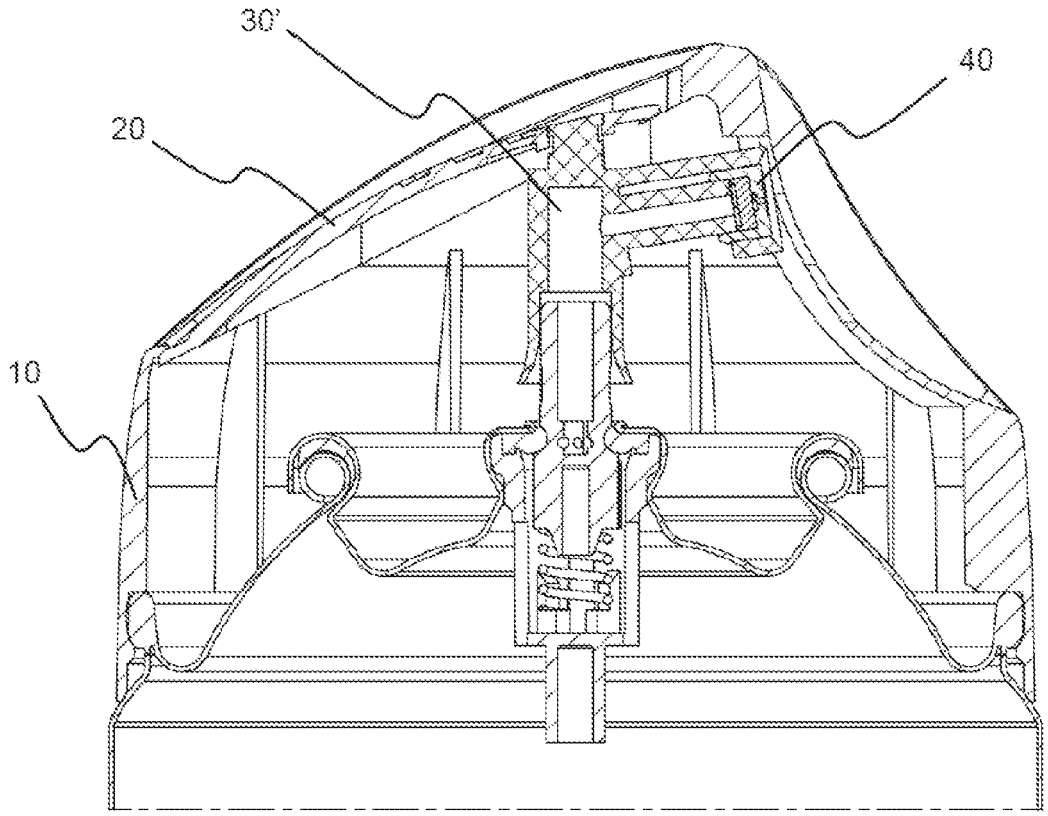

The invention is described in more detail with the aid of an exemplary embodiment presented in the following figures which show:

FIG. 1: Perspective views of a dispenser according to the invention, (a) equipped with a nozzle, and (b) without nozzle;

FIG. 2: A cross-sectional view of the dispenser of FIG. 1 equipped with a nozzle;

FIG. 3: Enlargements of FIG. 2 at the nozzle housing, (a) with the nozzle, and (b) without the nozzle;

FIG. 4: Perspective views of the retaining means viewed from inside the dispenser, (a) with the nozzle, and (b) without the nozzle;

FIG. 5: Perspective views of the nozzle housing, viewed in the direction of the inside of the dispenser and in cross-section perpendicular to the axis of the outlet conduit, at the sealing zone, (a) with the nozzle and (b) without the nozzle;

FIG. 6: Views similar to those of FIG. 5, but in the retaining area, (a) with the nozzle, and (b) without the nozzle;

FIG. 7: Views in the same cross-section plane as in FIG. 6, but viewed in the direction towards the outside of the dispenser, (a) with the nozzle, and (b) without the nozzle;

FIG. 8: Views in alignment with the outlet conduit, viewed from outside the dispenser, (a) with the nozzle, and (b) without the nozzle;

FIG. 9: Perspective views of a nozzle, (a) from the back, and (b) from the front;

FIG. 10: A cross-section view of a variant of the dispenser of FIG. 1 equipped with a snapped-on outlet channel and provided with a nozzle.

The invention relates to a dispenser (1) intended to actuate the valve of an aerosol generator in order to dispense its contents. Such a dispenser is provided essentially with a tubular skirt (10), a finger tab (20) located at the top of the skirt, and an outlet channel (30, 30') placed inside the dispenser, under the finger tab with which it cooperates to actuate the valve. The finger tab can be articulated on the skirt by means of a strip (21) so that it can be pushed in towards the inside of the dispenser by pivoting about an axis passing through the strip. It can also be separated from the skirt by being able to be pushed in towards the inside of the dispenser either by translation or by pivoting about a fulcrum.

The outlet channel (30, 30') is constituted by a conduit (31) and a nozzle housing (32) intended to receive a nozzle. The first end (311) of the conduit (31) is designed to actuate the valve of a pressurized container such as an aerosol generator and the second end (312) opens into the nozzle housing (32). In the present example, the first end of the conduit (311) is dimensioned to cooperate with the stein (also called rod or spray outlet) of a valve of the male type. It would also be possible for this first end to be designed to actuate a valve of the female type. In addition, the nozzle housing extends around an axis (A).

The outlet conduit (31) shown in the figures is divided into two sections:

- a first section that is substantially vertical and, in the state mounted on a valve, is located in the extension of the stem of the valve, and
- a second section that is inclined relative to the first section, in the example presented here, at an angle of approximately 76°.

The second section extends along the axis (A), at least at the second end (312) of the conduit. The inclination of the second section is dictated only by the intended use of the dispenser or the desired aesthetics. Depending on needs, it can be horizontal, inclined downwards, inclined upwards as in the present example, or even vertical and in the extension of the first section.

To facilitate understanding, the adjectives "downstream" and "upstream" as used in the remainder of the description relate to the direction of flow of the product when the dispenser is mounted on a pressurized container. Likewise, the adjectives "radial" or "axial" as used relate to the axis (A).

The outlet channel (30) can be an integral part of the finger tab under which it is formed during molding of the finger tab, as in the present example. In another embodiment not shown, it can be connected to the skirt, for example, by a flexible strip. Finally, it can be constituted by an added-on part (30') fixed to the skirt or to the finger tab during assembly, such as the conduit described in French patent application FR 19 00 676. In the example of FIG. 10, the outlet conduit (30') and the base body of the dispenser, constituted by the skirt (10) and the finger tab (20), are two distinct parts connected together by mechanical attachment means, in particular by snap-fastening, for example, of a tenon placed at the top of the outlet conduit (30') in a corresponding opening made in the finger tab (20).

The outlet channel (30, 30'), at the second end (312) of the conduit, forms a cylindrical stud (33) that ends with a front face (331) and over which the nozzle (40) must be slid. The stud (33) protrudes slightly into the nozzle housing (32), which is delimited by a tubular wall (34) coaxial with the stud, but of larger diameter. Opposite to the stud (33), this nozzle housing opens to the outside, either in the skirt or in the finger tab (as is the case in the example presented here), depending on needs.

The nozzle (40) is constituted essentially by a tubular wall (41) closed at a first end by a front wall (42) provided with an outlet orifice (421) and open at the other end. The tubular wall (41) is provided on its outer face, near the open end, with a retention ring (43) whose downstream face (431) directed towards the front wall is substantially radial, while the opposite upstream face (432) is preferably inclined so as to form a ramp. The retention ring therefore constitutes a hook. The inner face of the front wall (42) can be provided with reliefs to improve the quality of the jet. The nozzle can also be provided with an internal part (44) also intended to improve the quality of the jet. The nozzle is thus provided with a recess (45) into which the stud (33) can penetrate.

In the dispensers of the state of the art, the nozzle housing forms a blind hole closed at the bottom by a radial wall into which the second end (312) of the conduit opens. The end of the conduit can be flush with this bottom wall, or, as in the present example, it can be continued by a stud (33) that projects from the bottom wall into the nozzle housing. The nozzle is introduced into the nozzle housing until its open end, opposite to the front wall (42), touches the bottom wall of the nozzle housing, or, when there is a stud, the nozzle is slid over the stud (33) until the inner face of the front wall of the nozzle, or the inner face of the internal part (44), touches the front face of the stud (33). The nozzle is slid into the housing by force. The diameter of the retention ring (43) of the nozzle is greater than the diameter of the cylindrical wall (34) of the nozzle housing. The retention ring acts as a "hard tooth" that comes to be caught into the softer material of the nozzle housing. The nozzle is therefore retained in the housing by deformation of the latter. This retention system also ensure sealing at the interface between the retention ring and the deformed cylindrical wall of the nozzle housing.

In the device of the invention, the upstream end of the nozzle housing (32), located on the side of the outlet channel, is at least partly open. The tubular wall (34) is provided, at a distance from its end open towards the outside, with a support surface (341) that extends over at least a portion of its periphery, and behind which at least a portion of the retention ring (43) of a nozzle introduced into the nozzle housing can come into engagement. The support surface (341) is defined by at least an angular section of a surface having rotational symmetry with respect to the axis (A). In the simplest embodiment, the support surface (341) is substantially radial. When the channel (30) is, as here, an integral part of the finger tab (20), it is not possible to mold in a simple manner a support surface (341) over the entire circumference of the tubular wall (34). In other words, at least a portion of the upstream portion of the tubular wall (34) is continued by an extension (342) beyond the support surface (341) in the direction opposite to the open end, thus extending a corresponding portion of the nozzle housing. The tubular wall (34) is therefore divided into two angular sections: the first ends with the support surface (341) and the second, complementary to the first, is continued by the extension (342). In the example presented here, the two angular sections are approximately equal and have a value of about 180°. This is clearly visible in FIGS. 4, 6, 7 and 8. This means that about 50% of the retention ring is snapped behind the support surface and the remaining 50% is retained by deformation of the extension (342). Of course, other values could be provided, in particular as a function of molding constraints.

When the nozzle (40) is introduced into the nozzle housing (32), its retention ring (43) slides along the tubular wall (34) until a portion of its downstream face (431) penetrates into the opening located upstream of the support surface (341) of the tubular wall (34) and comes to be engaged behind said support surface (341) where there is such a support surface. The rest of the retention ring (43)

acts as a "hard tooth" on the extension (342), as is the case in the state of the art. This situation is clearly visible in FIG. 3*a*. In the lower portion, the retention ring (43) is engaged with the support surface (341), while in the upper portion, the retention ring (43) has deformed the extension (342) of the tubular wall (34) by acting like a "hard tooth". Thus, the nozzle (40) is retained partly by snapping-on of the retention ring (43) behind the support surface (341) and partly by deformation of the extension (342) of the tubular wall. The snapping-on of the retention ring behind the support surface, on the one hand, and the retention of the retention ring by deformation of the extension (342), on the other hand, constitute retaining means of the nozzle in the nozzle housing. When the nozzle is engaged behind the support surface, the front face (331) of the stud is preferably in contact with the inner face of the front wall (42) of the nozzle, or with the rear face of the internal part (44), with an assembly clearance that takes into account the dimensional tolerances of the different parts.

While sealing is ensured in the area of the deformation of the extension (342) of the tubular wall by the retention ring (43), this is not always the case in the area of the snap-fastening of the retention ring on the support surface. It is therefore preferable to provide additional sealing means. In the example presented here, the inside diameter of the tubular wall (41) of the nozzle is less than the outside diameter of the stud (33). This way, the nozzle is slid over the stud (33) by force, so that the annular interface (35) between the outer face of the stud (33) and the inner face of the tubular wall (41) of the nozzle forms a sealed connection, which is clearly visible in FIGS. 3*a*, 5*a*, 6*a* and 7*a*. For a more reliable result, it is preferable that the stud (33) protrudes into the nozzle housing (32) beyond the support surface (341) so that the front end of the stud (33) is placed further downstream than the support surface. In other words, the front face (331) of the stud is axially closer to the open end of the tubular wall (34) than the support surface (341). Thus, the sealing function and the retaining function are separate. Sealing could be obtained by means other than an adjustment of the annular interface. For example, a seal could be provided between the front face of the stud and the inner face of the front wall of the nozzle or the inner face of the internal part.

Among the possible materials for the nozzle housing, and therefore generally for the finger tab or even the dispenser, one can mention polymer materials (PE, PP, PLA, PHA, PBS), whether new or recycled, made from petroleum or from natural resources, biodegradable or not, or even compostable or not. They can contain mineral fillers (glass, basalt, etc.), be reinforced with mineral or vegetable fibers. It is also possible to envision non-polymeric materials, such as lignin-based materials (cardboard, wood), materials containing textiles, metals, etc. For the nozzle, by way of non-limiting example, mention can be made of POM, PBT, PA, or more generally any polymer sufficiently rigid to ensure a hard tooth effect while being able to be injected with great precision.

Thanks to the invention, it is possible to manufacture dispensers that can receive and retain nozzles up to pressures of at least 20 bars. The nozzles used on dispensers of the state of the art provided with a nozzle housing forming a blind hole can be used in this new dispenser. Thus, it is not necessary to have a stock of specific nozzles. The invention is suitable both for monobloc nozzles and for two-part nozzles such as those described in patent application PCT/EP2018/078705.

LIST OF REFERENCES

1 Dispenser
10 Skirt
20 Finger tab
  21 Articulation strip
30 Outlet channel
  31 Conduit
    311 1st end of the conduit
    312 2th end of the conduit
  32 Nozzle housing
  33 Stud
    331 Front face of the stud
  34 Cylindrical wall
    341 Support surface
    342 Extension
  35 Stud/nozzle sealed interface
30' Outlet channel (added-on, snapped-on part)
40 Nozzle
  41 Tubular wall
  42 Front wall
    421 Jet outlet orifice
  43 Retention ring
    431 Downstream face
    432 Upstream face
  44 Internal part
  45 Recess
A Axis of the nozzle housing

The invention claimed is:

1. Dispenser for a pressurized container, comprising:
an outlet channel, and
a nozzle housing intended to receive and retain a nozzle provided with a retention ring,
wherein the outlet channel opens into the nozzle housing,
wherein the nozzle housing comprises a tubular wall that extends around an axis and is open towards an outside at an end thereof opposite to the outlet channel, and
wherein the tubular wall is provided, at a distance from the end thereof open towards the outside, with a support surface that extends over at least a portion of a periphery thereof and behind which a first portion of a retention ring of the nozzle introduced into the nozzle housing can come into engagement,
wherein the support surface extends only over an angular section of the periphery of the tubular wall, the tubular wall being continued, opposite to the open end thereof, in the angular section complementary to the support surface, by an extension into which a second portion of the retention ring of the nozzle which is not engaged with the support surface can come to be caught by deformation of the extension.

2. Dispenser according to claim 1, wherein the support surface is defined by at least an angular section of a surface having rotational symmetry relative to the axis.

3. Dispenser according to claim 2, wherein the support surface is substantially radial relative to the axis.

4. Dispenser according to claim 3, wherein sealing means are provided between the nozzle housing and the nozzle introduced into the housing, the sealing means being distinct from an interaction between the retention ring of the nozzle and the tubular wall of the nozzle housing.

5. Dispenser according to claim 3, wherein the outlet channel is provided, at an end thereof that opens into the nozzle housing, with a stud intended to penetrate into a corresponding recess of the nozzle.

6. Dispenser according to claim 2, wherein sealing means are provided between the nozzle housing and the nozzle introduced into the housing, the sealing means being distinct from an interaction between the retention ring of the nozzle and the tubular wall of the nozzle housing.

7. Dispenser according to claim 2, wherein the outlet channel is provided, at an end thereof that opens into the nozzle housing, with a stud intended to penetrate into a corresponding recess of the nozzle.

8. Dispenser according to claim 1, wherein sealing means are provided between the nozzle housing and the nozzle introduced into the housing, the sealing means being distinct from an interaction between the retention ring of the nozzle and the tubular wall of the nozzle housing.

9. Dispenser according to claim 1, wherein the outlet channel is provided, at an end thereof that opens into the nozzle housing, with a stud intended to penetrate into a corresponding recess of the nozzle.

10. Dispenser according to claim 9, wherein a transverse cross-section of the stud is dimensioned to be greater than a transverse cross-section of the recess of the nozzle for which it is intended, so as to be able to create, when the nozzle is placed in the nozzle housing with the stud penetrating into the recess, a sealed annular surface at the interface between the stud and the nozzle.

11. Dispenser according to claim 10, wherein the stud protrudes into the nozzle housing so that a front face thereof is axially closer to the open end of the tubular wall than the support surface.

12. Dispenser according to claim 9, wherein the stud protrudes into the nozzle housing so that a front face thereof is axially closer to the open end of the tubular wall than the support surface.

13. Dispenser according to claim 9, wherein a transverse cross-section of the tubular surface, a transverse cross-section of the stud, or both a transverse cross-section of the tubular surface and a transverse cross-section of the stud have a shape of a circle.

14. Dispenser according to claim 1, further comprising the nozzle provided with the retention ring, the nozzle being introduced into the nozzle housing, the first portion of the retention ring being engaged behind the support surface, the second portion of the retention ring of the nozzle which is not engaged with the support surface being attached to the tubular surface by deformation of its extension.

15. Dispenser for a pressurized container, comprising:

an outlet channel, and a nozzle housing intended to receive and retain a nozzle provided with a retention ring, wherein the outlet channel opens into the nozzle housing, wherein the nozzle housing comprises a tubular wall that extends around an axis and is open towards an outside at an end thereof opposite to the outlet channel, and wherein the tubular wall is provided, at a distance from the end thereof open towards the outside, with a support surface that extends over at least a portion of a periphery thereof and behind which at least a portion of a retention ring of the nozzle introduced into the nozzle housing can come into engagement, wherein the outlet channel is provided, at an end thereof that opens into the nozzle housing, with a stud intended to penetrate into a corresponding recess of the nozzle, wherein a transverse cross-section of the stud is dimensioned to be greater than a transverse cross-section of the recess of the nozzle for which it is intended, so as to be able to create, when the nozzle is placed in the nozzle housing with the stud penetrating into the recess, a sealed annular surface at the interface between the stud and the nozzle.

16. Dispenser according to claim 15, wherein the stud protrudes into the nozzle housing so that a front face thereof is axially closer to the open end of the tubular wall than the support surface.

17. Dispenser according to claim 15, wherein a transverse cross-section of the tubular surface, a transverse cross-section of the stud, or both a transverse cross-section of the tubular surface and a transverse cross-section of the stud have a shape of a circle.

18. Dispenser according to claim 15, further comprising the nozzle provided with the retention ring, the nozzle being introduced into the nozzle housing, at least a portion of the retention ring being engaged behind the support surface, the nozzle being placed in the nozzle housing with the stud penetrating into the recess, forming a sealed annular surface at the interface between the stud and the nozzle.

19. Dispenser for a pressurized container, comprising:

an outlet channel, and a nozzle housing intended to receive and retain a nozzle provided with a retention ring, wherein the outlet channel opens into the nozzle housing, wherein the nozzle housing comprises a tubular wall that extends around an axis and is open towards an outside at an end thereof opposite to the outlet channel, and wherein the tubular wall is provided, at a distance from the end thereof open towards the outside, with a support surface that extends over at least a portion of a periphery thereof and behind which at least a portion of a retention ring of the nozzle introduced into the nozzle housing can come into engagement, wherein the outlet channel is provided, at an end thereof that opens into the nozzle housing, with a stud intended to penetrate into a corresponding recess of the nozzle, wherein the stud protrudes into the nozzle housing so that a front face thereof is axially closer to the open end of the tubular wall than the support surface.

20. Dispenser according to claim 19, further comprising the nozzle provided with the retention ring, the nozzle being introduced into the nozzle housing, at least a portion of the retention ring being engaged behind the support surface, the nozzle being placed in the nozzle housing with the stud penetrating into the recess, a front face thereof being axially closer to the open end of the tubular wall than the support surface.

* * * * *